US009828232B2

(12) United States Patent
Szeteli

(10) Patent No.: US 9,828,232 B2
(45) Date of Patent: Nov. 28, 2017

(54) WITHDRAWAL SYSTEM

(71) Applicant: as Strömungstechnik GmbH, Ostfildern (DE)

(72) Inventor: Andreas Szeteli, Ostfildern (DE)

(73) Assignee: as Strömungstechnik GmbH, Ostifildern (DE)

( * ) Notice: Subject to any disclaimer, the term of this patent is extended or adjusted under 35 U.S.C. 154(b) by 31 days.

(21) Appl. No.: 14/915,912

(22) PCT Filed: Aug. 15, 2014

(86) PCT No.: PCT/EP2014/067461
§ 371 (c)(1),
(2) Date: Mar. 2, 2016

(87) PCT Pub. No.: WO2015/032604
PCT Pub. Date: Mar. 12, 2015

(65) Prior Publication Data

US 2016/0194193 A1 Jul. 7, 2016

(30) Foreign Application Priority Data

Sep. 9, 2013 (DE) ..... 10 2013 109 799

(51) Int. Cl.

| | |
|---|---|
| ***B67D 7/02*** | (2010.01) |
| ***B67D 7/34*** | (2010.01) |
| ***B67D 1/08*** | (2006.01) |
| ***B67D 7/22*** | (2010.01) |
| ***B67D 7/62*** | (2010.01) |

(52) U.S. Cl.
CPC ..... *B67D 7/0288* (2013.01); *B67D 1/0802* (2013.01); *B67D 1/0829* (2013.01); *B67D 7/221* (2013.01); *B67D 7/348* (2013.01); *B67D 7/62* (2013.01)

(58) Field of Classification Search
CPC ..... B67D 7/0288; B67D 7/62; B67D 7/221; B67D 7/348; B67D 1/0829; B67D 1/0802
See application file for complete search history.

(56) References Cited

U.S. PATENT DOCUMENTS 4,263,945 A * 4/1981 Van Ness ..... B67D 7/348 137/234.6
5,727,608 A * 3/1998 Nusbaumer ..... B67D 7/145 141/231

(Continued)

FOREIGN PATENT DOCUMENTS

DE 102012104170 A1 5/2013
EP 0977702 A1 2/2000

(Continued)

*Primary Examiner* — Nicolas A Arnett
(74) *Attorney, Agent, or Firm* — Michael Soderman

(57) ABSTRACT

The invention relates to a withdrawal system (1) for filling and emptying containers and involves a container closure (2) that is inserted into a container opening of a container seating a bung head. An immersion pipe (4) connected to the bung head has an extraction connector element connected to the immersion pipe (4) or the bung head. A transponder generating a transponder signal is provided; a monitoring signal is generated in dependence upon the transponder signal that indicates whether there is a permissible connection of the extraction connector element to the container.

13 Claims, 2 Drawing Sheets

(56) References Cited

U.S. PATENT DOCUMENTS

| | | | | |
|---|---|---|---|---|
| 6,079,597 | A * | 6/2000 | Rauworth | B65D 1/20 137/212 |
| 6,357,494 | B1 * | 3/2002 | Hahn | B67D 1/0802 141/367 |
| 6,425,502 | B1 * | 7/2002 | Rauworth | B65D 1/20 137/212 |
| 6,568,427 | B2 * | 5/2003 | Imai | B67D 7/0283 137/590 |
| 6,634,396 | B2 * | 10/2003 | Ozawa | B67D 1/0835 137/588 |
| 6,879,876 | B2 * | 4/2005 | O'Dougherty | B67D 7/0283 700/231 |
| 8,381,768 | B2 * | 2/2013 | Hasegawa | B67D 7/0261 137/212 |
| 9,126,749 | B2 * | 9/2015 | Hodges | B65D 23/02 |
| 9,580,197 | B2 * | 2/2017 | Szeteli | B65B 69/0075 |
| 2004/0172160 | A1 | 9/2004 | O'Dougherty et al. | |
| 2006/0283932 | A1 * | 12/2006 | Asp | B65C 7/00 235/375 |
| 2010/0276033 | A1 * | 11/2010 | Asp | B65C 7/00 141/2 |
| 2012/0256756 | A1 * | 10/2012 | Johnson | G06K 7/0008 340/687 |
| 2015/0068623 | A1 * | 3/2015 | Szeteli | B65B 69/0075 137/551 |

FOREIGN PATENT DOCUMENTS

| | | | |
|---|---|---|---|
| GB | 2383990 | A | 7/2003 |
| GB | 2480671 | A | 11/2011 |
| WO | 2006110714 | A2 | 10/2006 |

* cited by examiner

WITHDRAWAL SYSTEM

CROSS REFERENCE TO RELATED APPLICATIONS

This application is the U.S. national stage of International Application No. PCT/EP2014/067461, filed on Aug. 15, 2014, and claims the priority thereof. The international application claims the priority of German Application No. DE 10 2013 109 799.5 filed on Sep. 9, 2013; all applications are incorporated by reference herein in their entirety.

BACKGROUND

The invention relates to a withdrawal system in accordance with the preamble of claim 1.

A withdrawal system of that type is known from EP 0 977 702 B1. This withdrawal system serves to fill and empty containers, especially barrels, that are filled with liquid chemicals. The withdrawal system described there has a container closure. The container closure is generally inserted into a container opening seating a bung head. The container closure itself has an immersion pipe, capable of being connected to the bung head, via which liquids stored in the container can be removed and via which liquids can be fed into the container. Furthermore, the container closure has an extraction connector element that is typically designed in the form of an extraction head and that can be connected to the bung head.

A fluid is then removed from the container via the extraction connector element or, if applicable, a fluid is also fed in. A pump is connected via the extraction connector element here to carry out the removal or supply of a fluid.

The liquids stored in the containers typically involve special liquid chemicals. Even based on safety reasons alone, liquids have to be capable of being withdrawn from the containers, just as the liquids have to be capable of being fed into the containers, without the possibility of a mistake. Furthermore, a withdrawal of this type that rules out a mix-up is also required for reasons relating to a minimization of contamination, because the connection of an incorrect extraction connector element that was already used for different chemicals would lead to contamination of the chemicals in the container that the extraction connector element is coupled with.

To prevent the risk of a mix-up of that type, a suggestion is made in EP 0 977 702 B1 to provide coding recesses in the bung head of the respective container. An annular disk with coding studs is assigned to the extraction connection element accompanying the container by attaching the annular disk in a coupling stopper that is screwed onto the extraction connector element to fix it in place on the bung head.

The coding studs of the annular disk form an unambiguous, individualized coding in such a way that the coding studs only fit the coding recesses of the matching container. A connection of the extraction connector element to the associated container that rules out a mix-up is therefore ensured.

A drawback here, however, is the fact that additional mechanical parts are required to rule out a mix-up with the coding studs and the coding recesses, which substantially increases the construction expense of the container closure. One drawback in particular is that the coding studs are arranged on an annular disk that has to be fit as a separate accessory part into the design of the container closure, which is why the container closure has an expensive design structure. A further drawback is that the mechanical coding can be manipulated by removing all of the studs on the extraction head.

SUMMARY

The invention relates to a withdrawal system (1) for filling and emptying containers and involves a container closure (2) that is inserted into a container opening of a container seating a bung head. An immersion pipe (4) connected to the bung head has an extraction connector element connected to the immersion pipe (4) or the bung head. A transponder generating a transponder signal is provided; a monitoring signal is generated in dependence upon the transponder signal that indicates whether there is a permissible connection of the extraction connector element to the container.

DETAILED DESCRIPTION

The invention is based on the objective of providing a withdrawal system of the type described at the outset that ensures a connection of containers that rules out a mix-up with low construction costs.

The elements of claim 1 are specified to solve this problem. Advantageous embodiments and useful design developments of the invention are described in the subclaims.

The invention relates to a withdrawal system for filling and emptying containers and involves a container closure that is inserted into a container opening of a container seating a bung head. An immersion pipe connected to the bung head has an extraction connector element connected to the immersion pipe or the bung head. A transponder generating a transponder signal is provided; a monitoring signal is generated in dependence upon the transponder signal that indicates whether there is a permissible connection of the extraction connector element to the container.

The basic idea of the invention is to consequently ensure a connection of a container closure to a container that rules out a mix-up via electrical signals of a transponder in order to ensure a withdrawal system that operates in an error-free manner.

A first important advantage of the invention is the fact that the transponder, which is used to prevent the risk of a mix-up, can be installed without any design adaptations to the container closure or immersion pipe worth mentioning. Simplified mounting of the container closure results because of that, because no mechanical parts have to be additionally attached to the container closure to carry out the coding.

Another advantage of the transponder that is used as per the invention is that a multitude of data can be stored in it. In particular, a multitude of different transponder signals can therefore be generated to form monitoring signals; a substantially greater number of coding possibilities results because of that with respect to mechanical coding systems, which can be used to reliably distinguish a large number of liquids, especially chemicals, that are stored in different containers. Finally, it is advantageous that the containers can be identified in a manipulation-proof manner with the data stored in the transponder.

A connection of container closures to containers can consequently be realized without the possibility of a mix-up with the transponder system as per the invention, even in complex systems with a large number of containers holding different liquids.

As a special advantage, the withdrawal system has a control unit that controls the supply of liquid to the container and/or the withdrawal of liquid from the container in dependence upon the monitoring signal.

The automatic control realized with the control unit takes place in such a way that liquid is only withdrawn from a container or poured into a container when a permissible connection of the extraction connector element to the respective container is reported with the monitoring signal, so erroneous matches can be reliably prevented.

As a preference, the control unit controls a pump for filling and emptying the container; the pump is only activated by the control unit when the control unit receives a monitoring signal from the transponder that reports the connection of a permissible extraction connector element to the container.

Further automation of the overall withdrawal system is also possible via the signal generated in dependence upon the transponder signal of the transponder. It is especially advantageous when the control unit drives a robot that is designed to connect the extraction connector element to the immersion pipe. The robot is only released by the control unit to make this connection when the control unit receives a monitoring signal from the transponder that reports the connection of a permissible extraction connector element to the container.

A warning signal transmitter driven by the monitoring signal that emits a warning signal when the connection of an impermissible extraction connector element is reported with the monitoring signal is also advantageous.

The warning signal transmitter can be designed in the form of a lamp for emitting visual warning signals or in the form of a horn for emitting acoustic warning signals.

Finally, the functionality of the withdrawal system can be expanded by storing information in the transponder relating to the container closure or to materials in the container.

The large storage capacity in the transponder is thereby used to precisely describe and document additional data that involves the container and the liquid contained inside of it. Data of that type could be, as an example, the manufacturing date of the container or of the container closure or materials used for it. Customer information can also be stored in the transponder.

It is advantageous that the information stored in the transponder can be read out into the control unit.

This data can be evaluated there or stored for purposes of documentation and traceability.

The transponder used in the withdrawal system as per the invention has, in a well-known way, a transmitter and a receiver; data stored in the transmitter in the form of transponder signals can be read into the receiver in a contact-free way.

Data identifying the respective container and the liquid contained in it, especially a code that unambiguously identifies the liquid, is stored in the transmitter.

The transmitter of the transponder is firmly connected to the container to obtain a fixed, unambiguous assignment of the transmitter to this container.

It is advantageous when the transmitter of the transponder is integrated into the immersion pipe. Alternatively, the transponder is arranged in a suitable place on the container.

The code stored in the transmitter is read out into the receiver, and the monitoring signal is generated in dependence upon the code.

In accordance with a first variant of the invention, the receiver or an antenna of the receiver is connected to the extraction connector element. A code identifying the extraction connector element is stored in the receiver, and the monitoring signal is generated via a comparison of this code with the code stored in the transmitter.

The receiver of the transponder has a fixed assignment to the extraction connector element or to each extraction connector element in this variant. The receiver is unambiguously identified by the code in the receiver and can thus be unambiguously distinguished from receivers of other transponders.

Both the container with the liquid contained in it and the extraction connector element are therefore unambiguously identified via the comparison of the code of the transmitter with the code of the receiver. An assignment of the extraction connector element to the container that rules out a mix-up is then ensured via the comparison of the codes.

The comparison of the codes for generating the monitoring signal can be done in the receiver itself or in the control unit that the receiver is connected to. In any case, the monitoring signal is available in the control unit, so the control unit can have liquid withdrawn or poured in for the container in dependence upon the monitoring signal.

In accordance with a second variant of the invention, the receiver is spatially separated from the extraction connector element and the extraction connector element is identified by the control unit.

The monitoring signal is solely generated in dependence upon the code read out by the transmitter of the transponder here.

In this case, there is no code in the receiver that identifies the extraction connector element because a fixed spatial assignment of the receiver to the extraction connector element is lacking and a code of that type in the receiver would not unambiguously identify the extraction connector element.

The extraction connector element of a container closure is identified by the control unit itself in this case. As an example, there is only one extraction connector element in a room in which several containers could in fact exist, so the extraction connector element is known in the control unit because of this spatial assignment.

The monitoring signal can then be generated solely with the aid of the code stored in the respective transponder of a container in that case, and a determination can be made in that way as to whether there is a permissible connection of the extraction connector element to this container.

BRIEF DESCRIPTION OF THE DRAWINGS

The invention will be explained with the aid of the drawings below. The following are shown in the figures.

DETAILED DESCRIPTION OF THE PREFERRED EMBODIMENT

Figure 1:
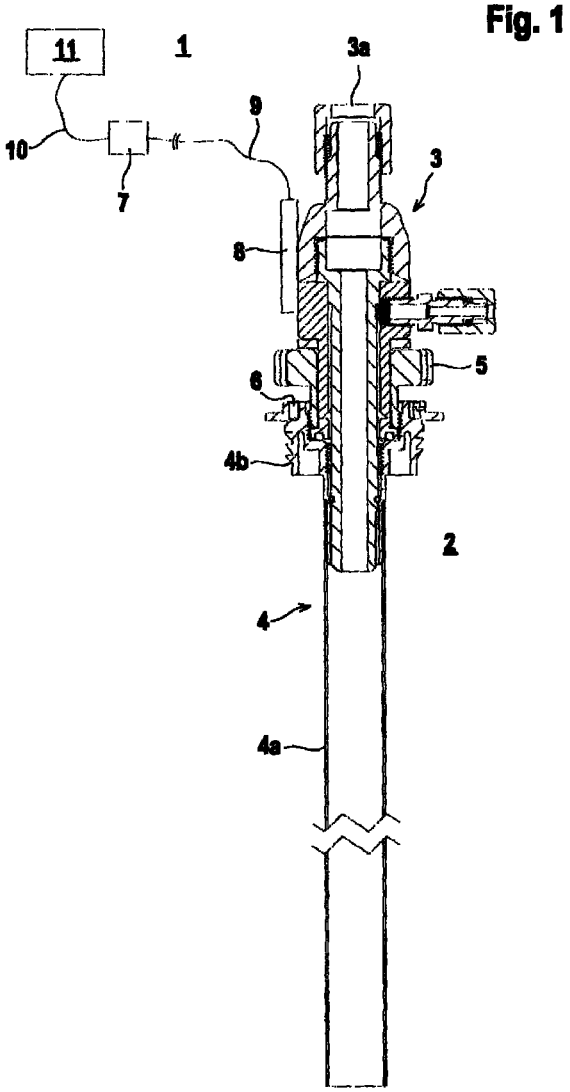
FIG. 1: First example of the withdrawal system as per the invention.

FIG. 1 shows a first example of the withdrawal system 1 as per the invention. FIG. 1 shows, as an important component of the withdrawal system 1, a container closure 2 for a transportable container that is not shown, which is comprised of barrel or the like. A liquid is stored in the container. Liquids stored in containers of that type especially involve special liquid chemicals.

The container closure 2 is comprised of an extraction connector element in the form of an extraction head 3 and an immersion pipe 4. The immersion pipe 4 is mounted in a bung head, not shown, that is seated in an opening of the container and is therefore firmly connected to the container. The immersion pipe 4 has at its upper end a head piece 4*b* that is broadened with respect to a hollow cylindrical pipe element 4*a* of the immersion pipe 4 for this. The pipe element 4*a* of the immersion pipe 4 projects into the interior of the container down to its base area.

The extraction head 3 serves to withdraw liquids in the container. The extraction head 3 has a connection for liquids 3*a* at its upper end for that. A line, not shown, which leads to a pump, likewise not shown, can be connected to this connection for liquids 3*a*. A gas connection 3*b* via which the pressure can be balanced out in the container opens out laterally at the extraction head 3.

The extraction head 3 is fastened via a screw connection to the immersion pipe 4. A locking nut 5 with an external thread is screwed into a thread in the immersion pipe 4 to form this screw connection.

A transponder is used as per the invention to ensure a connection of the extraction head 3 to a container that rules out a mix-up. The transponder has a transmitter 6 that is designed in the form of a component encapsulated in plastic and a receiver 7 with an antenna 8.

In the instant case, the transponder is designed to be a passive transponder, meaning that the transmitter 6 does not have its own voltage supply. The transmitter 6 draws its energy via an induction field built up by the receiver 7; transponder signals stored in the transmitter 6 in a contact-free way are also transmitted in a contact-free way to the receiver 7. Alternatively, the transponder can be designed as an active transponder with its own voltage supply like a battery, for instance.

As is evident in FIG. 1, the transmitter 6 is integrated into the immersion pipe 4; the transmitter 6 is firmly arranged in the head piece 4*b* of the immersion pipe 4.

The antenna 8 of the receiver 7 is fastened to the side of the extraction head 3. A cable 9 is routed from the antenna 8 to the receiver 7. The receiver 7 is connected via a further cable 10 to a control unit 11. In principle, the receiver 7 can also be integrated into the control unit 11.

The extraction head 3, as shown in FIG. 1, is screwed onto the immersion pipe 4 for a withdrawal of liquid from the container or a supply of liquid into the container. The transmitter 6 is then within the range of the antenna 8, so data stored in the transmitter 6 is transmitted to the receiver 7.

Data of that type can optionally be made up of information describing the containers or the liquid stored there, for instance the nature of the liquid or the components of the container, customer information, manufacturing date of the container or the liquid and the like. This information can be passed along via the receiver 7 to the control unit 11 and evaluated or stored there.

A first code is stored in the transmitter 6 via which the liquid in the container is unambiguously identified. This first code is transmitted from the transmitter 6 to the receiver 7 and then compared with a second code stored in the receiver 7; the extraction head 3 that the antenna 8 of the receiver 7 is arranged on is unambiguously identified in this way.

After that, there is a comparison of both codes; a monitoring signal is generated with the aid of the comparison, and its signal spacing indicates whether the extraction head 3 is connected to a permissible or impermissible container. The monitoring signal can be generated in the receiver 7 in principle. The monitoring signal that is formed in that way is then read into the control unit 11. Alternatively, the monitoring signal can be directly generated in the control unit 11.

A connection of extraction heads 3 to containers that rules out a mix-up is ensured with the aid of the monitoring signal generated via the transponder signal of the transponder, which means that it is ensured that an extraction head 3 is always correctly connected to the container assigned to it. An incorrect withdrawal of liquids from containers is therefore prevented, and a contamination of liquids due to the use of an incorrect extraction head 3 is also avoided.

The monitoring signal forms a safety signal; the liquid withdrawal or supply is controlled by the control unit 11 in dependence upon that. The control unit 11 only allows the activation of the pump connected to it for the withdrawal or supply of liquid when an error-free, permissible connection of the respective extraction head 3 to a container is reported by the monitoring signal. To increase the safety, a warning signal transmitter that emits a warning signal when there is an impermissible connection of an extraction head 3 to a container can also be controlled with monitoring signals. The warning signal transmitter can be a lamp or a horn, for instance.

Since there is automatic recognition of whether the connection of an extraction head 3 to a container is permissible or not with the monitoring signal, the extraction head 3 can also be physically connected to the immersion pipe 4 by a robot, wherein it is also controlled in dependence upon the monitoring signal.

Figure 2:
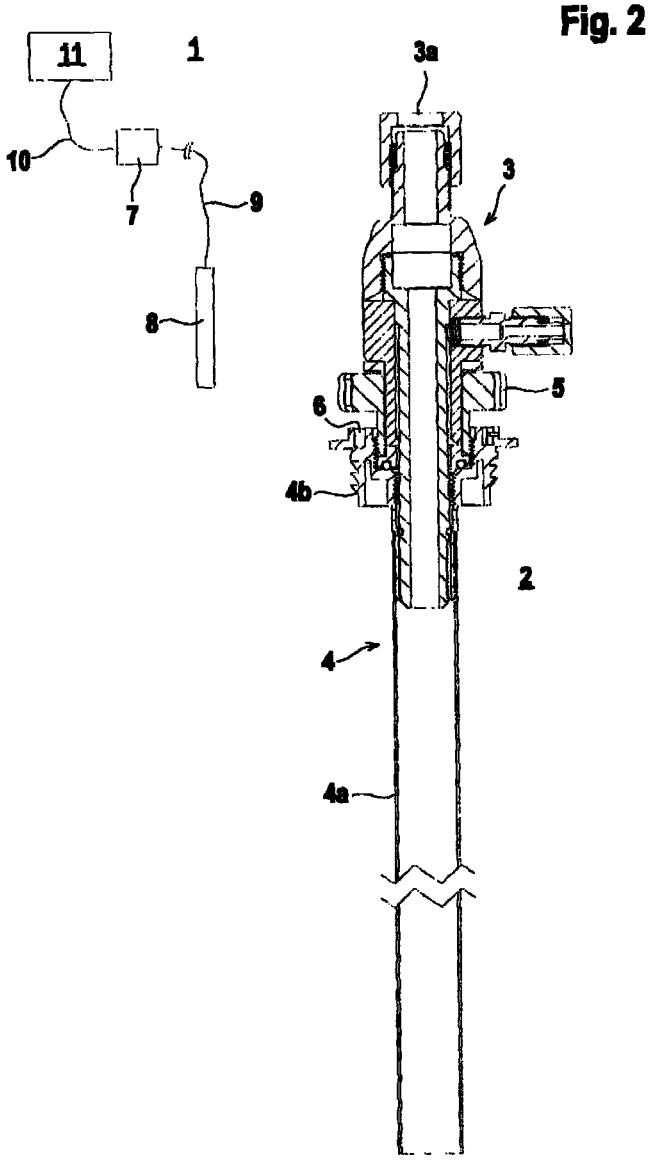
FIG. 2: Second example of the withdrawal system as per the invention.

FIG. 2 shows a second example of the withdrawal system 1 as per the invention. This example only differs from the embodiment in accordance with FIG. 1 by the fact that the antenna 8 of the receiver 7 is not firmly connected to the extraction head 3. Thus, there is no fixed spatial assignment between the receiver 7 and the extraction head 3.

This embodiment is especially suitable for a withdrawal system 1 that only has one extraction head 3, but several containers that are to be correctly assigned to the extraction head 3. Since only one extraction head 3 is envisaged, mix-ups of different extraction heads 3 are ruled out, so there is also no code stored in the receiver 7 that identifies the extraction head 3 in this case. Accordingly, in this case, the monitoring signal is solely formed from the code stored in the transmitter 6 of the transponder. Otherwise, the operation of the withdrawal system 1 in accordance with FIG. 2 corresponds to that of the embodiment in accordance with FIG. 1.

LIST OF REFERENCE NUMERALS (1) Withdrawal system
(2) Container closure
(3) Extraction head
(3*a*) Connection for liquids
(3*b*) Gas connection
(4) Immersion pipe
(4*a*) Pipe element
(4*b*) Head piece
(5) Locking nut
(6) Transmitter
(7) Receiver
(8) Antenna
(9) Cable
(10) Cable
(11) Control unit

The invention claimed is:

1. A withdrawal system (1) for filling and emptying containers with a container closure (2) that is inserted into a container opening of a container seating a bung head and that has an immersion pipe (4) connected to the bung head and an extraction connector element connected to the immersion pipe (4) or the bung head, wherein a transponder generating a transponder signal is included, and wherein a monitoring signal is generated in dependence upon the transponder signal that indicates whether a permissible connection of the extraction connector element to the container exists, characterized in that said withdrawal system has a control unit (11) that controls the supply of liquid into the container and/or the withdrawal of liquid out of the container in dependence upon the monitoring signal and in that the control unit (11) controls a robot that is designed to connect the extraction connector element to the immersion pipe (4), wherein the robot is only allowed by the control unit (11) to effect this connection when the control unit (11) receives notification by the monitoring signal from the transponder that the connection of the extraction connector element to the container is permissible.

2. The withdrawal system according to claim 1, characterized in that the transponder has a transmitter (6) that is firmly connected to the container and a receiver (7) assigned to the transmitter (6).

3. The withdrawal system according to claim 2, characterized in that the transmitter (6) of the transponder is integrated into the immersion pipe (4).

4. The withdrawal system according to claim 3, characterized in that the code stored in the transmitter (6) is read out into the receiver (7) and the monitoring signal is generated in dependence upon the code.

5. The withdrawal system according to claim 2, characterized in that a code identifying the container and/or the liquid contained in the container is stored in the transmitter (6) of the transponder.

6. The withdrawal system according to claim 1, characterized in that the receiver (7) or an antenna (8) of the receiver (7) is connected to the extraction connector element, that a code identifying the extraction connector element is stored in the receiver (7) and that the monitoring signal is generated via a comparison of this code with the code stored in the transmitter (6).

7. The withdrawal system according to claim 1, characterized in that the receiver (7) is spatially separated from the extraction connector element and that the extraction connector element is identified by the control unit (11).

8. The withdrawal system according to claim 7, characterized in that the monitoring signal is generated solely in dependence upon the code read out from the transmitter (6) of the transponder.

9. The withdrawal system according to claim 1, characterized in that the control unit (11) controls a pump for filling and emptying the container.

10. The withdrawal system according to claim 9, characterized in that the pump is only activated by the control unit (11) when the control unit (11) receives notification by the monitoring signal from the transponder that the connection of the extraction connector element to the container is permissible.

11. The withdrawal system according to claim 1, characterized in that a warning signal transmitter is controlled by the monitoring signal that emits a warning signal when the monitoring signal reports that the connection of the extraction connector element is impermissible.

12. The withdrawal system according to claim 1, characterized in that information involving the container closure (2) or material contained in the container is stored in the transponder.

13. The withdrawal system according to claim 12, characterized in that the information stored in the transponder can be read out into the control unit (11).

* * * * *